US007867680B2

(12) United States Patent
Mikuriya et al.

(10) Patent No.: US 7,867,680 B2
(45) Date of Patent: Jan. 11, 2011

(54) NON-MAGNETIC TONER FOR ONE-COMPONENT DEVELOPMENT AND METHOD OF PREPARING THE TONER, AND IMAGE DEVELOPER, IMAGE FORMING APPARATUS, PROCESS CARTRIDGE AND IMAGE FORMING METHOD

(75) Inventors: Yoshihiro Mikuriya, Nishinomiya (JP); Kazuoki Fuwa, Kawanishi (JP); Hiroaki Katoh, Nagaokakyo (JP); Yoshitaka Sekiguchi, Nishinomiya (JP); Hideaki Yasunaga, Ibaraki (JP); Masayuki Hagi, Minoh (JP)

(73) Assignee: Ricoh Company Limited, Tokyo (JP)

( * ) Notice: Subject to any disclaimer, the term of this patent is extended or adjusted under 35 U.S.C. 154(b) by 130 days.

(21) Appl. No.: 12/348,494

(22) Filed: Jan. 5, 2009

(65) Prior Publication Data

US 2009/0186291 A1 Jul. 23, 2009

(30) Foreign Application Priority Data

Jan. 21, 2008 (JP) ..... 2008-010430

(51) Int. Cl.

| | |
|---|---|
| ***G03G 9/087*** | (2006.01) |
| ***G03G 5/00*** | (2006.01) |
| ***G03G 15/08*** | (2006.01) |
| ***G03G 21/18*** | (2006.01) |
| ***G03G 13/20*** | (2006.01) |

(52) U.S. Cl. ..... 430/109.1; 430/137.18; 399/111; 399/119; 399/122; 399/320

(58) Field of Classification Search ..... 430/109.1, 430/137.18; 399/111, 119, 122, 320
See application file for complete search history.

(56) References Cited

U.S. PATENT DOCUMENTS

| | | | | |
|---|---|---|---|---|
| 2004/0161688 | A1* | 8/2004 | Itakura et al. | 430/108.4 |
| 2005/0014079 | A1* | 1/2005 | Itakura et al. | 430/45 |
| 2006/0292474 | A1 | 12/2006 | Mikuriya et al. | |
| 2007/0122729 | A1 | 5/2007 | Katoh et al. | |
| 2008/0153018 | A1 | 6/2008 | Mikuriya et al. | |
| 2008/0159777 | A1 | 7/2008 | Fuwa et al. | |
| 2008/0233506 | A1 | 9/2008 | Hagi et al. | |

FOREIGN PATENT DOCUMENTS

| | | |
|---|---|---|
| JP | 2003-255741 | 9/2003 |
| JP | 2004-85605 | 3/2004 |
| JP | 2006-47585 | 2/2006 |
| JP | 2006-276825 | 10/2006 |
| JP | 2008-158327 | 7/2008 |

* cited by examiner

*Primary Examiner*—Hoa V Le
(74) *Attorney, Agent, or Firm*—Oblon, Spivak, McClelland, Maier & Neustadt, L.L.P.

(57) ABSTRACT

A non-magnetic toner including a binder resin including a first resin, a second resin, a third resin; a colorant; and a wax, wherein the first resin is a hybrid resin including an amorphous condensation polymerization unit and a radical polymerization unit in its molecular frame, and the second and third resins are non-hybrid resins including condensation polymerization units, wherein each of the first, second and third resins has a glass transition temperature (Tg) and a softening point (Tm) satisfying the following relationships:

Tg of first resin<Tg of second resin<Tg of third resin, which is from 70 to 80° C., and Tm of second resin<Tm of third resin<Tm of first resin, and wherein the binder resin includes the first resin in an amount of from 10 to 20% and the third resin of from 25 to 45% by weight.

17 Claims, 3 Drawing Sheets

NON-MAGNETIC TONER FOR ONE-COMPONENT DEVELOPMENT AND METHOD OF PREPARING THE TONER, AND IMAGE DEVELOPER, IMAGE FORMING APPARATUS, PROCESS CARTRIDGE AND IMAGE FORMING METHOD

BACKGROUND OF THE INVENTION

1. Field of the Invention

The present invention relates to a non-magnetic toner for one-component development, and more particularly to an oilless fixable toner and a method of preparing the toner, and an image developer, an image forming apparatus, a process cartridge and an image forming method using the toner.

2. Discussion of the Background

Conventional electrophotographic image forming methods include charging the surface of an image bearer (photoreceptor), irradiating the surface thereof to form an electrostatic latent image thereon, developing the electrostatic latent image with a colored toner to form a toner image thereon, transferring the toner image onto a receiving material such as a transfer paper, and fixing the toner image thereon. Dry developing methods used in electrophotographic image forming methods and electrostatic recording methods include a method of using a two-component developer including a toner and a carrier, and a method of using a one-component developer not including a carrier. The former stably produces good images, but is difficult to produce constant-quality images for long periods because the carrier is easy to deteriorate and a mixing ratio of the toner to the carrier (toner concentration) is easy to vary. In addition, image forming apparatuses using the two-component developer are difficult to maintain and downsize. Therefore, the latter method of using the one-component developer is drawing attention.

The method of using the one-component developer typically feeds a toner, i.e., a developer with at least one toner feeding member to visualize an electrostatic latent image formed on a latent image bearer (photoreceptor) with the toner. The toner fed by and on the toner feeding member has to have as thin a layer thickness as possible. Particularly when a one-component developer (toner) having high electric resistivity, the toner layer has to have significantly a thin thickness because of needing to be charged by an image developer. Namely, when the toner layer has a thick thickness, only the surface thereof is charged and it is difficult to uniformly charge the whole toner layer.

As a means of regulating the thickness of the toner layer (hereinafter referred to as a "layer thickness regulator") on the toner feeding member, various methods are disclosed. For example, a regulation blade (press member) is used as the layer thickness regulator, which faces the toner feeding member and presses the toner fed thereby to regulate the layer thickness thereof. In addition, a roller instead of the blade may contact the surface of the toner feeding member to regulate the layer thickness of a toner.

Recently, in order to downsize and lower cost of a fixer, an oilless fixer excluding a fixing oil applicator or reducing application quantity is mostly used. Therefore, a toner needs to include a release agent (wax) to have offset resistance. However, when a toner includes a wax too much, a free wax and a wax on the surface of a toner increase, resulting in adherence of the toner to a regulation blade or a photoreceptor in an image developer.

This is caused by a wax or a resin. The wax is mentioned above, and the hardness of resin matters. Namely, a soft resin breaks when passing the regulation blade, resulting in adherence thereto with a free wax. Further, solid images having blank spots or striped caused by the adherence are likely to be produced. Particularly, a color toner needs to include a binder resin having a low softening point to satisfy its light transmission, colorability and glossiness, resulting in occasional insufficient heat resistant storageability or aggregation of the toner when stored at high temperature.

A number of methods such as adjustment of wax quantity and improvement of binder resin have been disclosed to improve light transmission, colorability and glossiness of a toner without negative effects to other qualities.

Japanese published unexamined applications Nos. 2003-255741 and 2006-276825 disclose a hybrid resin including conventional condensation polymerization resins an vinyl resins having good affinity with a wax.

A combination of the hybrid resin and a wax can increase the wax and the dispersibility thereof in the toner improves. However, the toner lowers its viscosity and it is difficult to completely prevent the toner from adhering to the regulation blade.

Japanese published unexamined application No. 2004-85605 discloses a hybrid resin including a wax, which is prepared by mixing a mixture of material monomers of polymerization resins having independent reaction routes and a wax.

This method improves the dispersibility of a wax in a toner, however, the hybrid resin obtained from the material monomers alone does not have toughness and the toner occasionally cracks when stirred in an image developer.

Because of these reasons, a need exists for a toner for one-component development, fixable without oil, imparting good separativeness between a fixing member (a heating member and/or a pressure member) and a subject an image is transferred onto such as a recording paper, not adhering to or filming over a regulation member and a photoreceptor in an image developer, an having good developability and glossiness to produce high quality full-color images.

SUMMARY OF THE INVENTION

Accordingly, an object of the present invention is to provide a toner for one-component development, fixable without oil, imparting good separativeness between a fixing member (a heating member and/or a pressure member) and a subject an image is transferred onto such as a recording paper, not adhering to or filming over a regulation member and a photoreceptor in an image developer, an having good developability and glossiness to produce high quality full-color images.

Another object of the present invention is to provide a method of preparing the toner.

A further object of the present invention is to provide an image developer using the toner.

Another object of the present invention is to provide an image forming apparatus using the toner.

A further object of the present invention is to provide a process cartridge using the toner.

Another object of the present invention is to provide an image forming method using the toner.

These objects and other objects of the present invention, either individually or collectively, have been satisfied by the discovery of a non-magnetic toner for one-component development, comprising:

a binder resin, comprising:

a first resin, a second resin, a third resin;

a colorant; and a wax, wherein the first resin is a hybrid resin comprising an amorphous unit obtained from condensation polymerization and a unit obtained from radical polymerization in its molecular frame, and the second and third resins are non-hybrid resins comprising units obtained from condensation polymerization, respectively, wherein each of the first, second and third resins has a glass transition temperature (Tg) and a softening point (Tm) satisfying the following relationships:

Tg of the first resin<Tg of the second resin<Tg of the third resin, which is from 70 to 80° C., and Tm of the second resin<Tm of the third resin<Tm of the first resin, and wherein the binder resin comprises the first resin in an amount of from 10 to 20% by weight and the third resin of from 25 to 45% by weight.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
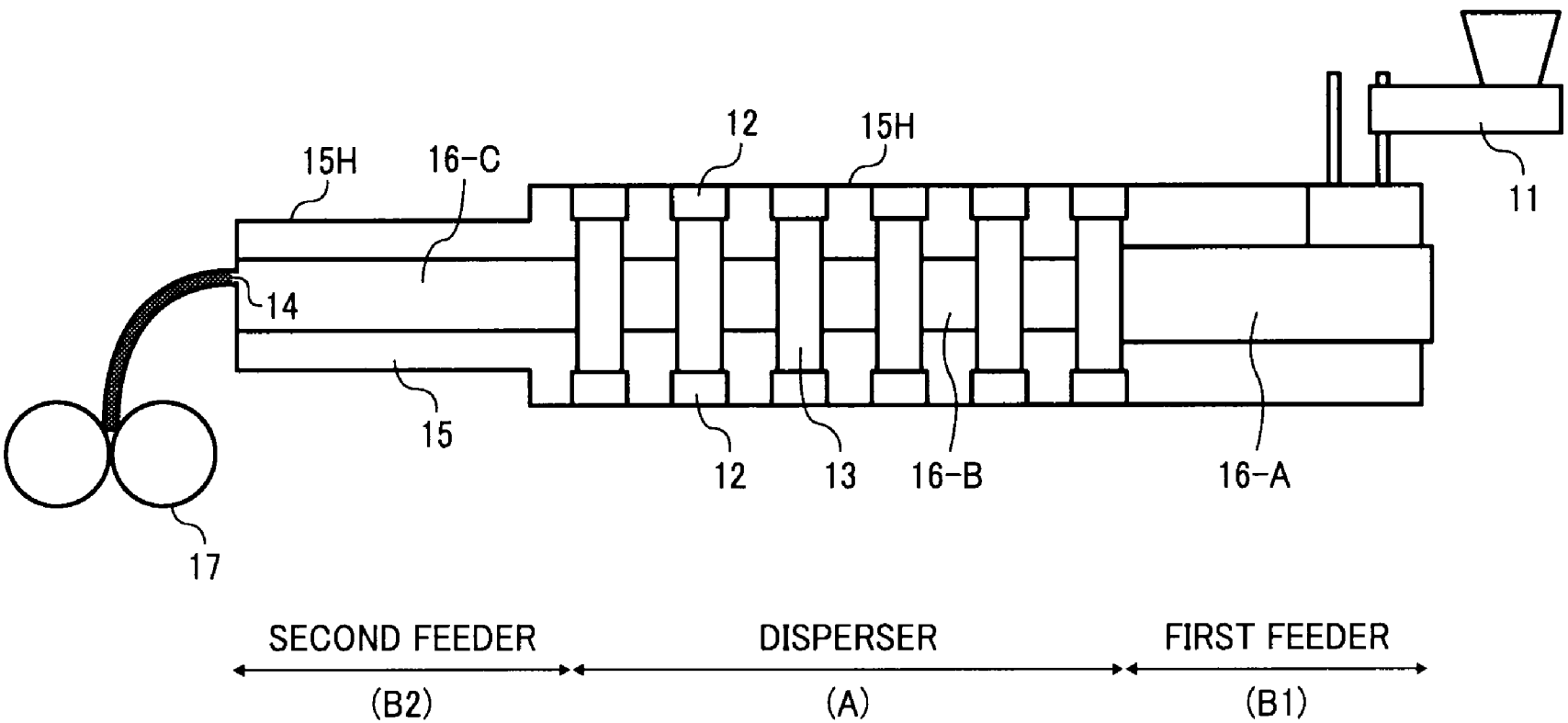
FIG. 1 is a schematic view illustrating an embodiment of a mortar kneader for use in the method of preparing the non-magnetic toner for one-component development of the present invention.

The present invention provides a toner for one-component development, fixable without oil, imparting good separativeness between a fixing member (a heating member and/or a pressure member) and a subject an image is transferred onto such as a recording paper, not adhering to or filming over a regulation member and a photoreceptor in an image developer, an having good developability and glossiness to produce high quality full-color images. Particularly, the present invention relates to a non-magnetic toner for one-component development, comprising:

a binder resin, comprising:

a first resin, a second resin, a third resin;

a colorant; and a wax, wherein the first resin is a hybrid resin comprising an amorphous unit obtained from condensation polymerization and a unit obtained from radical polymerization in its molecular frame, and the second and third resins are non-hybrid resins comprising units obtained from condensation polymerization, respectively, wherein each of the first, second and third resins has a glass transition temperature (Tg) and a softening point (Tm) satisfying the following relationships:

Tg of the first resin<Tg of the second resin<Tg of the third resin, which is from 70 to 80° C., and Tm of the second resin<Tm of the third resin<Tm of the first resin, and wherein the binder resin comprises the first resin in an amount of from 10 to 20% by weight and the third resin of from 25 to 45% by weight.

A wax can be uniformly dispersed in such a toner and effectively prevented from being released therefrom.

Conventionally, when a wax is mixed with toner materials in kneading and pulverizing methods to prepare a toner, the wax is inevitably released when the kneaded mixture is pulverized, resulting in significant deterioration of separativeness and developability of the toner, and production of images having many stripes.

As mentioned above, the three binder resins essentially have the following relationships:

Tg of the first resin<Tg of the second resin<Tg of the third resin, and

Tm of the second resin<Tm of the third resin<Tm of the first resin.

When the first resin has a low Tg as close to a melting point of the wax as possible and a vinyl component well compatible with the wax (a unit obtained from radical polymerization), a wax can be dispersed in the resin better than conventional hybrid resins and prevented from being released from the toner. Further, the first resin has a melting point higher than those of the other resins and the content thereof is a necessity minimum, which enables balancing the dispersibility of the wax and toughness of the resin.

When the three binder resins have the following relationships:

Tg of the first resin>Tg of the second resin>Tg of the third resin, a difference between the melting point of the wax and Tg becomes large, the wax is difficult to disperse in the toner.

When the three binder resins have the following relationships:

Tg of the second resin>Tm of the third resin>Tm of the first resin,

The toughness of the binder resin deteriorates, resulting in adherence of the toner to a regulation blade or a photoreceptor in an image developer.

In the present invention, the content of the first resin is essentially a necessity minimum. Namely, it is essential that the binder resin includes the first resin in an amount of from 10 to 20% by weight. When less than 10% by weight, the dispersibility of the wax in the toner deteriorates and the free wax increase, resulting in filming of the toner over, e.g., a photoreceptor. When greater than 20% by weight, the dispersibility of the wax improves, but the toughness of the binder resin deteriorates, resulting in adherence of the toner to a regulation blade or a photoreceptor in an image developer.

Such a combination of the resins has not been disclosed to prevent adherence and filming of a toner to a regulation blade or a photoreceptor.

Further, in the present invention, it is essential that the binder resin includes the third resin in an amount of from 25 to 45% by weight and that the third resin has a Tg of from 70 to 80° C. such that the resultant toner has high heat resistance. When less than 70° C., the developability of the resultant toner largely deteriorates. When greater than 80° C., the toughness of the binder resin deteriorates. The binder resin including the third resin in an amount of from 25 to 45% by weight enables balancing the developability and toughness.

It is preferable that the first resin preferably has a Tg of from 50 to 65° C. and a Tm of from 135 to 155° C., the third binder resin has a Tm of from 130 to 150° C., and that the binder resin includes the third binder resin in an amount of from 25 to 45% by weight.

In the present invention, the glass transition temperature (Tg) and the softening point (Tm) of a resin are measured by the following methods, respectively.

Precisely-measured 10 mg of a sample is placed in an aluminum pan of a differential scanning calorimeter DSC-200 from Seiko Instruments Inc., and the sample is heated up to 200° C. from a room temperature at a programming speed of 30° C./min and cooled. Next, the temperature is measured from 20 to 120° C. at a programming speed of 10° C./min. A shoulder value of the main endothermic peak from 30 to 90° C. in the heating process is determined as a Tg. Alumina is placed in aluminum pan as a reference.

1.0 g of a sample is placed in flow tester CFT-500 from Shimadzu Corp. using a die having a diameter of 0.5 mm and a height of 1.0 mm, and a temperature at a half of the sample flowed at a programming speed of 3.0° C./min, preheating time of 3 min, a load of 30 kgs from 40 to 140° C. is determined as a Tm.

In the present invention, it is further preferable that the first resin is a hybrid resin having both of a polyester frame unit and a vinyl copolymer frame unit, and that the second and third resins are non-hybrid resins having polyester frame units, respectively.

These combinations control the viscosity of a toner, assure the color reproducibility of a color toner, maintain the toughness of a polyester resin, prevent the adherence and filming of a toner to a regulation blade or a photoreceptor and maintains the separativeness thereof.

In addition, the toner of the present invention preferably produces images having glossiness of from 5 to 15. When less than 5, the color reproducibility largely deteriorates. When greater than 15, the viscosity of a resin is low, resulting in significant deterioration of the separativeness. This is because the toner of the present invention includes a wax in an amount of minimum necessity and a binder resin included therein largely affects the separativeness.

Hereinafter, the three binder resins (first, second and third resins), colorant, wax and other optional components for use in the toner of the present invention will be explained.

The three binder resins for use in the present invention are used in a non-magnetic toner for one-component development, and the toner needs to have suitable toughness. Therefore, it is preferable that the three binder resins are mostly polyester resins having units obtained from amorphous condensation polymerization in their molecular frames.

Particularly, the first binder resin in the three binder resin is preferably a polyester hybrid resin including a wax dispersion compatibility structural unit, i.e., a hybrid resin having both of a polyester frame unit and a vinyl copolymer frame unit, such as (meth)acrylic resins and styrene-(meth)acrylic copolymer resins in terms of good compatibility with a wax and oilless fixation needing no oil application to a fixer.

Specific examples of the non-hybrid resins, i.e., the second and third resins having units obtained from amorphous condensation polymerization in their molecular frames include polyester resin formed by polycondensation between a polyol and a polycarboxylic acid.

Specific examples of diols in the polyols include adducts of a bisphenol A such as polyoxypropylene(2,2)-2,2-bis(4-hydroxyphenyl)propane, polyoxypropylene(3,3)-2,2-bis(4-hydroxyphenyl)propane, polyoxypropylene(6)-2,2-bis(4-hydroxyphenyl)propane, polyoxyethylene(2,0)-2,2-bis(4-hydroxyphenyl)propane; ethylene glycol; diethylene glycol; triethylene glycol; 1,2-propylene glycol; 1,3-propylene glycol; 1,4-butadieneol; neo-pentyl glycol; 1,4-butenediol; 1,5-pentanediol; 1,6-hexanediol; 1,4-cyclohexanedimethanol; dipropyleneglycol; polyethyleneglycol; polytetramethyleneglycol; bisphenol A; hydrogenated bisphenol A; etc. Specific examples of tri- or more valent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, etc.

Specific examples of dicarboxylic acids in the polycarboxylic acids include a maleic acid, a fumaric acid, a citraconic acids, an itaconic acid, a glutaconic acid, a phthalic acid, an isophthalic acid, a terephthalic acid, a cyclohexane dicarboxylic acid, a succinic acid, an adipic acid, a sebacic acid, an azelaic acid, a malonic acid, a n-dodecenylsuccinic acid, an isododecenylsuccinic acid, a n-dodecylsuccinic acids, an isododecylsuccinic acid, a n-octenylsuccinic acid, an isooctenylsuccinic acid, a n-octylsuccinic acid, an isooctylsuccinic acid, their anhydrides or lower alkyl esters, etc.

Specific examples of tri- or more carboxylic acids include a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra (methylenecarboxyl)methane, a 1,2,7,8-octantetracarboxylic acid, an empol trimer acid, and their anhydrides and lower alkyl esters, etc.

In the present invention, as the polyester hybrid resin (the first resin having both of a unit obtained from amorphous condensation polymerization and a unit obtained from radical polymerization in its molecular frame), a resin having both of a unit obtained from amorphous condensation polymerization (polyester resin) and a unit obtained from radical polymerization (vinyl resin) in its molecular frame (hereinafter referred to as a "vinyl polyester resin") prepared by subjecting a mixture of a polyester resin material monomer, a vinyl resin material monomer and another monomer reactable with both of the monomers to a condensation and polymerization reaction and a radical polymerization reaction at the same time in a same container is preferably used as well.

The another monomer reactable with both of the monomers is, in other words, a monomer usable in both of the condensation and polymerization reaction and the radical polymerization reaction. Namely, the monomer is a monomer having a condensation-polymerization-reactable carboxyl group and a radical-polymerization-reactable vinyl group such as a fumaric acid, a maleic avid, an acrylic acid and a methacrylic acid.

Specific examples of the vinyl polyester resin material monomer include the polyols and polycarboxylic acids.

Specific examples of the radical polymerization unit (vinyl resin) include styrenes or their derivatives such as styrene, o-methylstyrene, m-methylstyrene, p-methylstyrene, α-methylstyrene, p-ethylstyrene, 2,4-dimethylstyrene, p-tert-butylstyrene and p-chlorostyrene; ethylene unsaturated monoolefins such as ethylene, propylene, butylene and isobutylene; methacrylate alkyl esters such as methylmethacrylate, n-propylmethacrylate, isopropylmethacrylate, n-butylmethacrylate, isobutylmethacrylate, t-butylmethacrylate, n-pentylmethacrylate, isopentylmethacrylate, neopentylmethacrylate, 3-(methyl)butylmethacrylate, hexylmethacrylate, octylmethacrylate, nonylmethacrylate, decylmethacrylate, undecylmethacrylate and dodecylmethacrylate; acrylate alkyl esters such as methylacrylate, n-propylacrylate, isopropylacrylate, n-butylacrylate, isobutylacrylate, t-butylacrylate, n-pentylacrylate, isopentylacrylate, neopentylacrylate, 3-(methyl)butylacrylate, hexylacrylate, octylacrylate, nonylacrylate, decylacrylate, undecylacrylate and dodecylacrylate; unsaturated carboxylic acids such as an acrylic acid, a methacrylic acid, an itaconic acid and a maleic acid; acrylonitrile; maleate ester; itaconate ester; vinylchloride; vinylacetate; vinylbenzoate; methylvinylketone; ethylvinylketone; hexylvinylketone; methylvinylether; ethylvinylether; isobutylvinylether; etc.

Specific examples of a polymerization initiator for polymerizing the radical polymerization unit (vinyl resin) include azo or diazo polymerization initiators such as 2,2'-azobis(2,4-dimethylvaleronitrile), 2,2'-isobutyronitrile, 1,1'-azobis (cyclohexane-1-carbonitrile) and 2,2'-azobis-4-methoxy-2,4-dimethylvaleronitrile; and peroxide polymerization initiators such as benzoylperoxide, dicumylperoxide, methylethylketoneperoxide, isopropylperoxycarbonate and lauroylperoxide.

The above-mentioned polyester resins are preferably used as the first, second and third resins. Particularly, in order to further improve the separativeness and offset resistance of the resultant oilless-fixable toner, the following first, second and third resins are more preferably used.

The first resin is more preferably a vinyl polyester resin prepared by a reaction among an alkylene oxide adduct of bisphenol A, terephthalic acid, trimellitic acid and succinic acid as polyester resin material monomers; styrene and butylacrylate as vinyl resin material monomers; and fumaric acid as a monomer reactable with both of the monomers.

The second resin is more preferably a polyester resin prepared by polycondensating the polyol and polycarboxylic acid, particularly an alkylene oxide adduct of bisphenol A as the polyol, and terephthalic acid fumaric acid as the polycarboxylic acids.

The third resin is more preferably a polyester resin prepared by a reaction among an alkylene oxide adduct of bisphenol A, terephthalic acid, trimellitic acid and succinic acid as polyester resin material monomers.

The contents of the first resin, and the second and third resins are preferably from 40/60 to 60/40, and more preferably from 45/55 to 55/45. The first and third resins are insufficient, the separativeness and hot offset resistance of the resultant toner deteriorate. The second resin is insufficient, the separativeness thereof deteriorates.

As mentioned above, the first, second and third resins have softening points of from 135 to 155° C., 100 to 120° C. and 130 to 150° C., respectively. The mixed resin formed of the first, second and third resins preferably has a softening point of from 120 to 130° C., and more preferably from 123 to 127° C.

The softening point of a resin is measured as mentioned above, and that of a toner is measured by the following method.

1.5 g of a sample is placed in flow tester CFT-500 from Shimadzu Corp. using a die having a diameter of 1.0 mm and a height of 1.0 mm, and a temperature at a half of the sample flowed at a programming speed of 3.0° C./min, preheating time of 3 min, a load of 30 kgs from 80 to 140° C. is determined as a Tm of a toner.

Each of the first, second and third resins preferably has an acid value of from 1 to 50 KOH mg/g, and more preferably from 5 to 40 KOH mg/g. Particularly, a polyester resin having such an acid value improves the dispersibility of colorants and forms a toner having good chargeability.

Each of the first and third resins preferably includes a tetrahydrofuran (THF)-insoluble component in an amount of from 0.1 to 15% by weight, more preferably from 0.2 to 10% by weight, and furthermore preferably from 0.3 to 5% by weight to prevent a toner form adhering to a regulation blade, etc. in an image developer. In addition, the first resin preferably includes the tetrahydrofuran(THF)-insoluble component more than the third resin.

The non-magnetic toner for one-component of the present invention includes a wax. Typically, a wax having lower polarity has better separativeness from a fixing roller.

Specific examples of the wax include natural ester waxes such as carnauba wax and rice wax; synthetic waxes such as polypropylene wax, polyethylene wax and Fischer-Tropsch wax; petroleum waxes such as paraffin wax; coal waxes such as montan wax; and alcohol waxes. These can be used alone or in combination. Among these waxes, natural ester waxes, Fischer-Tropsch wax and paraffin wax are preferably used to improve offset resistance of the resultant toner. These waxes have low viscosities and exude on the surface of a toner more than the others, and a minimum necessity thereof will do.

In the present invention, the wax preferably has a melting point of from 70 to 80° C., which is determined from a peak temperature on a DSC curve thereof. When higher than 80° C., the wax does not exude sufficiently on the surface of a toner at a low fixing temperature area and the toner is difficult to maintain separativeness from a fixer. When lower than 70° C., the toner particles are melted and bonded with each other in an environment of high-temperature and humidity.

The wax preferably has a half-value width of the endothermic peak not greater than 7° C., which is measured with a differential scanning calorimeter when heated. The wax in the present invention comparatively has a low melting point and a broad endothermic peak. Namely, a wax melting at a low temperature adversely affects the storage stability of the resultant toner.

The toner of the present invention preferably includes a wax in an amount of from 2.5 to 3.5% by weight, and more preferably from 2.75 to 3.25% by weight based on total weight of the three resins and the wax. When less than 2.5% by weight, the wax does not sufficiently exudes between the melted toner and a fixer and adhesiveness therebetween does not decrease, resulting in inseparability of recording materials from the fixer. When greater than 3.5% by weight, the wax exposed on the surface of a toner increases, resulting in deterioration of the fluidity thereof. The transferability of the toner from an image developer to a photoreceptor, and to a recording material therefrom deteriorates. Not only the resultant image quality significantly deteriorates, but also the wax leaving from the surface of a toner contaminates the image developer and photoreceptor.

The non-magnetic toner for one-component of the present invention includes a colorant. Known colorants conventionally used in full color toners can be used in the toner of the present invention.

Specific examples of the colorant include carbon black, Aniline Blue, calcoil blue, chrome yellow, ultramarine blue, Dupont Oil Red, QUINOLINE YELLOW, Methylene blue-chloride, Copper Phthalocyanine, Malachite Green Oxalate, lamp black, Rose Bengal, C.I. Pigment Red 48:1, C.I. Pigment Red 122, C.I. Pigment Yellow 97, C.I. Pigment Yellow 12, C.I. Pigment Yellow 17, C.I. Pigment Yellow 74, C.I. Solvent Yellow 162, C.I. Pigment Yellow 180, C.I. Pigment Yellow 185, C.I. Pigment Blue 15:1, C.I. Pigment Blue 15:3, etc.

The toner preferably includes the colorant in an amount of from 2 to 15 parts by weight per 100 parts by weight of all the binder resins. The colorant is preferably dispersed in a mixed binder resin of the first, second and third resins in the form of a masterbatch. The masterbatch preferably includes the colorant in an amount of from 20 to 40% by weight.

Known charge controlling agents conventionally used in full color toners can be used for the non-magnetic toner for one-component of the present invention.

Specific examples thereof include Nigrosine dyes, triphenylmethane dyes, chromium-containing metal complex dyes, molybdic acid chelate pigments, Rhodamine dyes, alkoxyamines, quaternary ammonium salts (including fluorine-modified quaternary ammonium salts), alkylamides, phosphor and its compounds, tungsten and its compounds, fluorine-containing activators, metal salts of salicylic acid, metal salts of salicylic acid derivatives, etc.

Specific examples of marketed charge controlling agents include BONTRON P-51 (quaternary ammonium salt), BONTRON E-82 (metal complex of oxynaphthoic acid), BONTRONE-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; quinacridone, azo pigments, and polymers having a functional group such as a sulfonate group, a carboxyl group, a quaternary ammonium group, etc.

Particularly, a charge controlling agent controlling a toner so as to have a negative polarity is preferably used. The content of the charge controlling agent in the toner is determined depending on the variables such as choice of binder resin, presence of additives, and dispersion method. In general, the content of the charge controlling agent is preferably from 0.05 to 5 parts by weight, and more preferably from 0.1 to 3 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

In the present invention, two inorganic particulate materials are preferably used as an external additive to support the fluidity, developability and chargeability of the resultant toner. The first inorganic particulate material preferably has a specific surface area of from 100 to 300 $m^2/g$ and the second inorganic particulate material of from 40 to 100 $m^2/g$ when measured by a BET method.

Specific examples of the inorganic particulate material include silicon oxide, zinc oxide, tin oxide, quartz sand, titanium oxide, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

A mother toner (including a binder resin, a colorant and a wax) in the present invention preferably includes an external additive in an amount of from 2.5 to 5.0 parts by weight. When greater than 5.0 parts by weight, the resultant toner produces more foggy images, and deteriorates in developability and separativeness.

In the present invention, toner materials including at least the hybrid resin (first resin), non-hybrid resins (second and third resins), a colorant and a wax are mixed, kneaded, pulverized and classified [for example, the toner materials are melted and kneaded by a kneader to prepare a kneaded mixture (a melting and kneading process), the kneaded mixture is extended upon application of pressure and cooled to prepare a extended and cooled mixture (an extending and cooling process), and the extended and cooled mixture is pulverized and classified (a pulverizing and classifying process)] by conventional methods to prepare toner particles (colored resin particles) having a desired particle diameter. The toner particles are optionally mixed with an external additive to prepare a non-magnetic toner for one-component development. The toner preferably has an average particle diameter of from 6 to 10 μm, and more preferably from 7 to 9 μm. The average particle diameter, i.e., a particle diameter distribution of a toner is measured as follows.

The particle diameter distribution of a toner can be measured by a Coulter counter TA-II or Coulter Multisizer II from Beckman Coulter as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

FIG. 1 is a schematic view illustrating an embodiment of the kneader. The kneader includes an independent toner material disperser having a heater (A), and a first feeder (B1) including an independent toner material feeder having a heater and a second feeder (B2) including an independent kneaded mixture outlet having a heater, sandwiching the disperser (A). B1 has a heater average temperature (C) of from 15 to 25° C., A has a heater average temperature (D) of from 30 to 40° C., and A and B2 have heater average temperatures having a difference (E) of from 65 to 85° C. therebetween. The extended and cooled mixture preferably has a thickness of from 2.5 to 3.0 mm.

Namely, the non-magnetic toner for one-component development of the present invention is typically prepared by melting and kneading toner materials with a heating kneader including an independent disperser and two independent feeders sandwiching the disperser to prepare a kneaded mixture, cooling, pulverizing and classifying the kneaded mixture.

Grind kneaders kneading materials between outer grind heads and inner grind heads upon application of rotation shearing strength are preferably used. The rotation shearing strength is controlled by adjusting a gap between the outer grind heads and inner grind heads. The kneaded mixture is extruded to be cooled in the present invention.

The gap between the outer grind heads and inner grind heads is preferably from 0.05 to 5 mm, and more preferably from 0.1 to 2 mm. The gap can be adjusted from 0.1 to 3 mm as desired at an interval of 0.01 mm.

As the toner materials, dry blend materials including at least a hybrid resin synthesized under the presence of a wax, a non-hybrid resin and a colorant are preferably used.

The toner materials are fed from a feeder 11, pass through a screw 16-A and are kneaded between outer grind heads 12 and inner grind heads 13. After passing through a transport path 16-B, the kneaded mixture passes through a screw 16-C in a cylinder 15 and is discharged from an outlet 14 to be extended upon application of pressure and cooled with a pres roller 17. Kneading conditions may be controlled by selecting the gap between the outer grind heads 12 and inner grind heads 13 and an inner temperature as desired.

A combination of the outer grind heads 12 and inner grind heads 13 is typically a disperser of a grind kneader. Therefore, screw structures other than the outer grind heads 12 and inner grind heads 13 are feeders. In FIG. 1, the screws 16-A and 16-C are two feeders sandwiching the disperser in the present invention. In addition, screws are feeders and a combination of discs other than screws is a disperser in a biaxial kneader. In FIG. 1, numeral 15H is a heater cover.

Typically, when the gap between the outer grind heads 12 and inner grind heads 13 becomes smaller, the wax has a smaller particle diameter. When the gap becomes larger, the wax has a larger particle diameter.

The gap between the outer grind heads 12 and inner grind heads 13 is furthermore preferably from 0.75 to 1.25 mm in the present invention.

The average heater temperatures (of B1, A and B2) in the present invention are averages of the respective heater bands thereof while working. Specifically, an average of the temperatures measured 1,000 times (one time/sec).

The average heater temperatures of B1 and A are preferably not higher than a Tg of a binder resin and that of B2 is preferably lower than a Tm thereof by from 10 to 20° C. to disperse a wax and pigment well. The disperser preferably has an inner temperature [A preferably has a heater average temperature (D)] of from 25 to 40° C., and more preferably from 30 to 40° C. The Tm is that of the binder resin including the three resins.

It is preferable that B1 has a heater average temperature (C) of from 15 to 25° C., and that A and B2 have heater average temperatures having a difference (E) of from 65 to 85° C. therebetween.

The screws typically have a rotation number of from 50 to 100 rpm, and preferably from 60 to 90 rpm.

The extended and cooled mixture preferably has a thickness of from 2.5 to 3.0 mm. When thinner than 2.5 mm, a wax evenly dispersed in a toner when kneaded agglutinates again, resulting in noises of the resultant images, such as stripes. When thicker than 3.0 mm, the mixture is insufficiently cooled, resulting in poor pulverization thereof.

The thickness of the extended and cooled mixture in the present invention is measured as follows.

The kneaded mixture discharged from a kneader is instantly pressed and extended by two cooling rolls, and just before pulverized the thickness thereof is measured by a slide gauge. In order to increase reliability, an average of 10 points measured thereby is determined as a final thickness.

The image developer of the present invention includes a developer bearer facing a photoreceptor and bearing a toner to develop a latent image formed on the photoreceptor, a feeder facing the developer bearer while contacting thereto and feeding the toner thereto, and a layer thickness regulator forming a thin layer of the toner fed from the feeder on the developer bearer and facing the developer bearer between opposed positions to the feeder and the photoreceptor in the traveling direction of the developer bearer. The image developer preferably has an upright structure having a toner feeder on the top, and the layer thickness regulator and the developer bearer preferably contact each other with their bodies.

Figure 2:
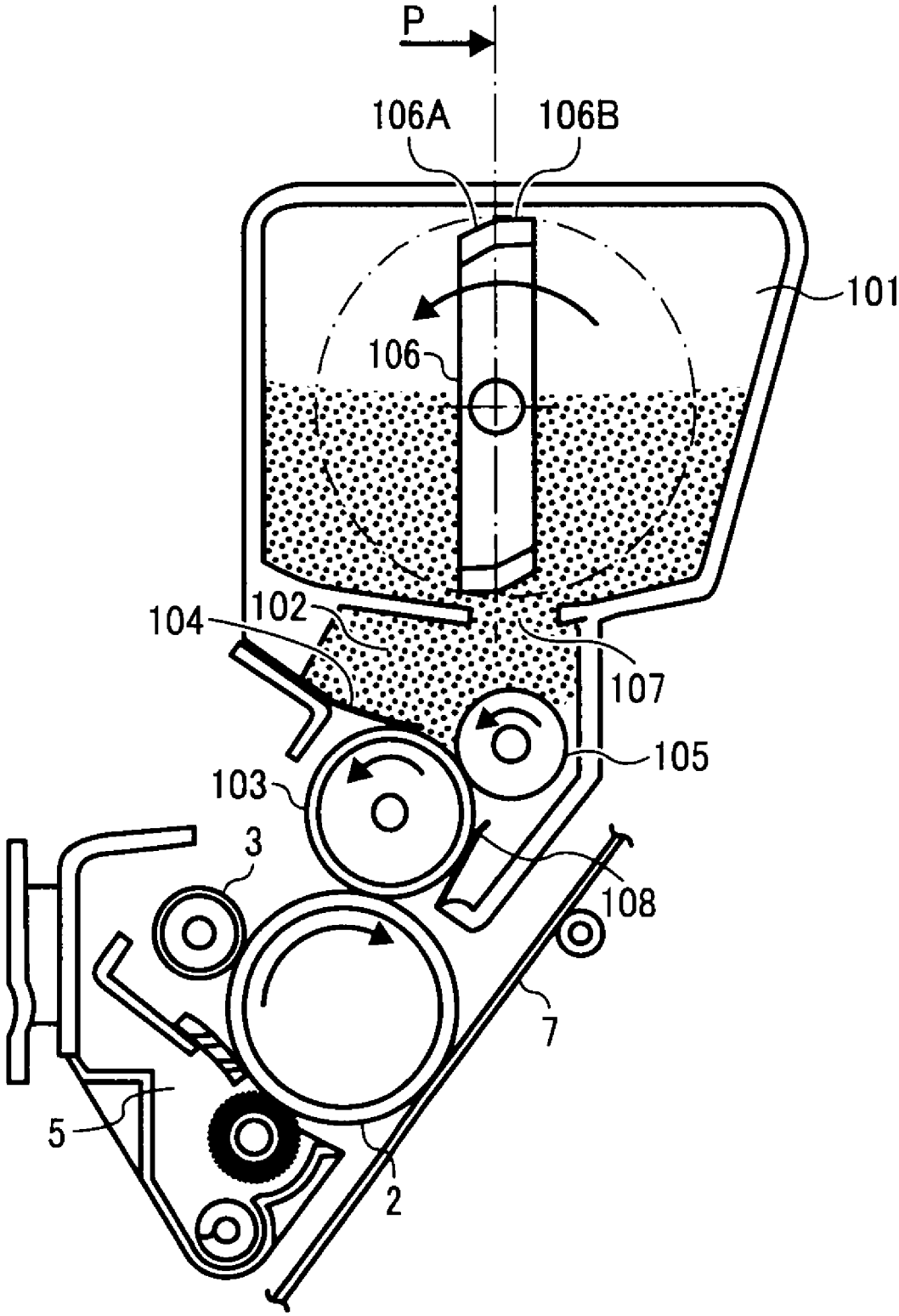
FIG. 2 is a schematic view illustrating embodiments of the image developer and the process cartridge of the present invention.

FIG. 2 is a schematic view illustrating embodiments of the image developer and the process cartridge of the present invention.

The image developer includes a toner container (101) and a tone feeding chamber (102) below the toner container (101). A developing roller (103), and a layer regulator (104) and a feed roller (105) contacting the developing roller (103) are located below the tone feeding chamber (102).

The developing roller (103) contacts the photoreceptor drum (2), a predetermined developing bias is applied to the developing roller (103) from a high-voltage power source (not shown). A toner stirring member (106) located in the toner container (101) rotates in anticlockwise direction. The toner stirring member (106) has a larger area at a part (106A) not passing near an opening (107) in the axial direction, and fully fluidizes and stirs a toner in the toner containing room (101). The toner stirring member (106) has a smaller area at a part (106B) passing near the opening (107) and prevents an excessive amount of the toner from leading thereto. The toner near the opening (107) is adequately stirred by the toner stirring member, passes through the opening (107) and falls into the toner feed room (102) under its own weight. The surface of the feed roller (105) is coated with a foamed material having cells, efficiently absorbs the toner fallen into toner feed room (102) and prevents the toner from deteriorating due to concentration of pressure at a contact point with the developing roller (103). The foamed material has an electrical resistivity of from $10^3$ to $10^{14}$ Ω·cm.

The feed roller (105) is applied with a feed bias offset in the same direction of the charge polarity of the toner against the developing bias. The feed bias presses the preliminarily-charged toner toward the developing roller (103) at a contact point therewith. However, the offset direction is not limited thereto, the offset may be zero or the offset direction may be changed depending upon the toner. The feed roller (105) rotates anticlockwise and feeds the toner adhering to the surface thereof to the surface of the developing roller (103) like coating. The developing roller (103) is coated with an elastic rubber layer and further coated with a surface layer formed of a material easily chargeable to have a polarity reverse to that of the toner. The elastic rubber layer has a hardness not greater than 50° when measured by JIS-A to maintain a constant contact to the photoreceptor drum (2), and further an electrical resistivity of from $10^3$ to $10^{10}$ Ω·cm. The elastic rubber layer has a surface roughness Ra of from 0.2 to 2.0 μm and holds a required amount of the toner at the surface thereof.

The developing roller (103) rotates anticlockwise and transfers the toner held at the surface thereof to the layer regulation member (104) and to a position facing the photoreceptor drum (2). The layer regulation member (104) is located at a position lower than the contact point between the feed roller (105) and the developing roller (103), and is a metallic plate spring material formed of SUS, phosphor bronze, etc. The layer regulation member (104) contacts its free end to the surface of the developing roller (103) at a pressure of from 10 to 100 N/m, and thins a layer of the toner and frictionally charges the toner. Further, the layer regulation member (104) is applied with a regulation bias offset in the same direction of the charge polarity of the toner against the developing bias to assist when frictionally charging the toner.

The photoreceptor drum (2) rotates clockwise, and therefore the surface of the developing roller (103) travels in the same direction of the traveling direction of the photoreceptor drum (2) at a position facing the photoreceptor drum (2). The thinned layer of the toner is transferred to the position facing the photoreceptor drum (2) and to the surface thereof to develop an electrostatic latent image according to the developing bias applied to the developing roller (103) and a latent image electric field formed by the electrostatic latent image. At a position where the toner remaining untransferred on the developing roller (103) returns into the toner feed room (102), a seal (108) is located contacting the developing roller (103) to prevent the toner form leaking out of the image developer.

The process cartridge of the present invention, which is detachable from an image forming apparatus, includes a photoreceptor and at least one of a charger charging the photoreceptor, an image developer and a cleaner in a body. In FIG. 2, the photoreceptor drum (2), a charger (3), the above-mentioned image developer and a cleaner (5) are included as the process cartridge. Numeral 7 is a receiving material (recording paper).

The image forming apparatus of the present invention including a photoreceptor, a charger, an irradiator, an image developer (the above-mentioned image developer), a transferer and a fixer, and using the non-magnetic toner for one-component development can stably produce quality images for long periods without application of an oil to a fixing member of the fixer. Therefore, the apparatus is uncomplicated, compact and low cost.

Namely, the photoreceptor is charged by the charger, an electrostatic latent image is formed on the charged surface of the photoreceptor by the irradiator, the non-magnetic toner for one-component development of the present invention is attached to the electrostatic latent image by the image developer to from a toner image, the toner image is transferred onto the receiving material by the transferer and fixed by the fixer to repeatedly and stably produce high quality images such as full-color images.

Figure 3:
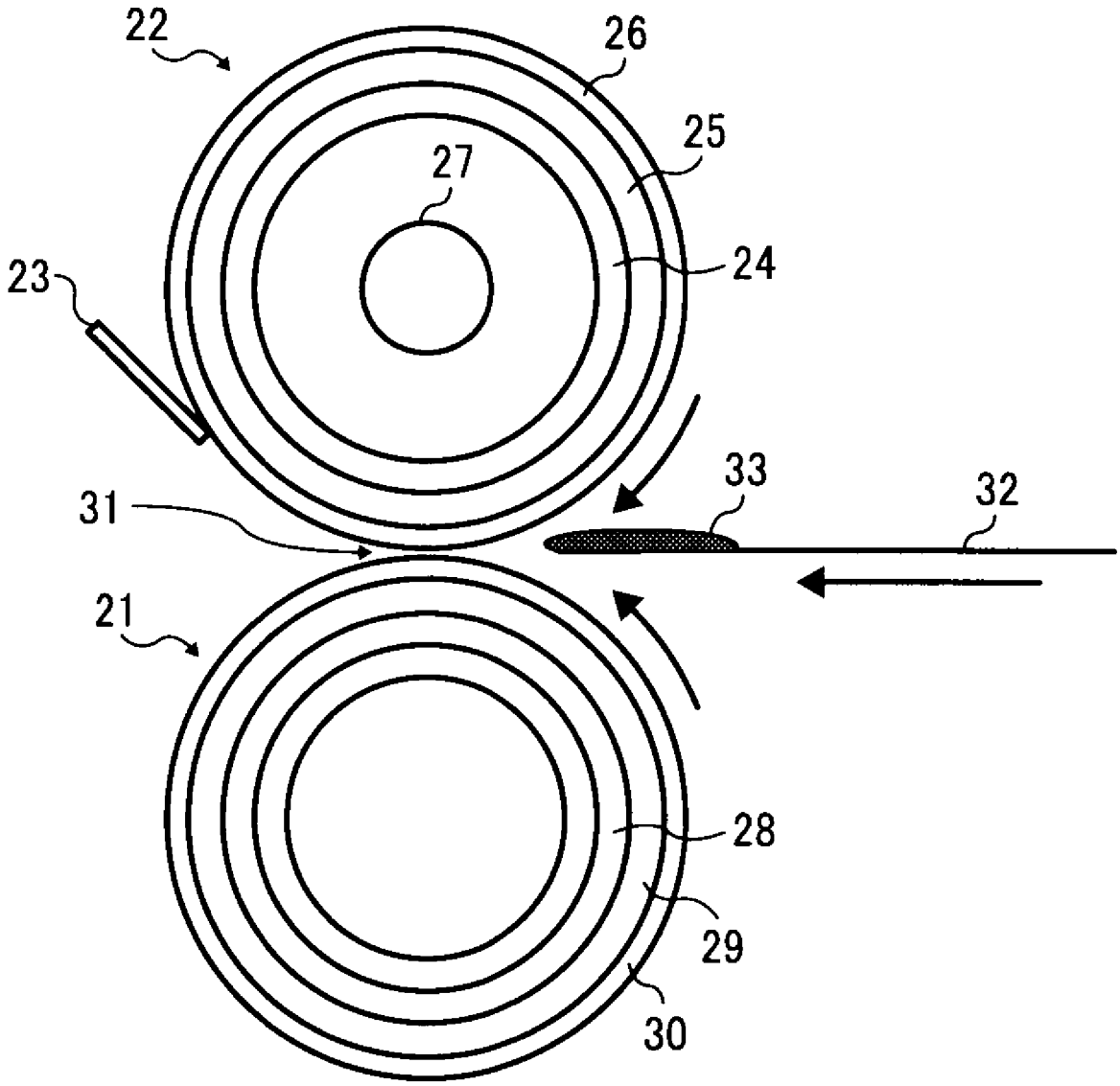
FIG. 3 is a schematic view illustrating an embodiment of two-roll fixers for use in the image forming apparatus of the present invention.

The fixer is preferably a two-roll fixer including a heat roller and a pressure roller as shown in FIG. 3, which evenly, stably and continuously fixes images developed by the non-magnetic toner for one-component development, such as full-color images, without occurrence of offset. In FIG. 3, numeral 21 is a pressure roller, 22 is a heat roller, 23 is a separating plate, 24 is an aluminum core metal, 25 is an elastic body layer, 26 is a surface layer, 27 is a heater, 28 is an aluminum core metal, 29 is an elastic body layer, 30 is a surface layer, 31 is a nip, 32 is a recording sheet and 33 is a toner image.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, to prepare a non-magnetic toner for one-component development (toner) for each Example and Comparative Example, the following hybrid resins (I-1 to I-8) including an amorphous unit obtained from condensation polymerization and a unit obtained from radical polymerization in its molecular frame, and non-hybrid resins (II-1 to II-7) and (III-1 to III-6) including units obtained from condensation polymerization, respectively.

[Synthesis of Hybrid Resins I-1 to I-8]

Styrene (St), butylacrylate (BA) and ethylhexylacrylate (EHA) as vinyl monomers and dicumylperoxide (DCP) as a polymerization initiator were placed in a dripping funnel under the formulation shown in Tables 1-1 and 1-2. Next, an adduct of bisphenol A with ethylene oxide (BPA-EO) and an adduct of bisphenol A with propylene oxide (BPA-PO) as alcohols of polyester resin monomers; an acrylic acid (AA), a succinic acid derivative (DSA), a fumaric acid (FA), a trimellitic acid (TMA) and a terephthalic acid (TPA) as acids; and a dibutylperoxide (DBO) as an esterification catalyst were placed in a glass four-neck flask having a thermometer, a stainless stirrer, a falling condenser and a nitrogen inlet tube under the formulation (Tables 1-1 and 1-2), and the vinyl monomers and a polymerization initiator were dropped in the flask under a nitrogen atmosphere in a mantle heater while heated and stirred. Then, after the mixture was maintained at a constant temperature and the addition polymerization reaction was completed, and the mixture was heated again to be subjected to a polycondensation reaction. The reaction was followed by measuring a softening point of the mixture. The reaction was stopped when the mixture had a predetermined softening point, and the mixture was cooled to have a room temperature to prepare hybrid resins (complex polyester resins) I-1 to I-8, each of which has a Tg and a Tm shown in Table 1-2.

[Synthesis of Non-Hybrid Resins II-1 to II-7 and III-1 to III-6]

Alcohols and acids each having an amount shown in Tables 1-1 and 1-2 were placed with a dibutyltinoxide (DBO) as a polymerization initiator in a glass four-neck flask having a thermometer, a stainless stirrer, a falling condenser and a nitrogen inlet tube to prepare a mixture therein. The mixture was reacted in a mantle heater while heated and stirred under a nitrogen atmosphere. The reaction was followed by measuring a softening point of the mixture. The reaction was stopped when the mixture had a predetermined softening point, and the mixture was cooled to have a room temperature to prepare polyester resins II-1 to II-7 and III-1 to III-6, each of which has a Tg and a Tm shown in Table 1-2.

In the present invention, the glass transition temperature (Tg) and the softening point (Tm) of a resin are measured by the following methods, respectively.

Precisely-measured 10 mg of a sample is placed in an aluminum pan of a differential scanning calorimeter DSC-200 from Seiko Instruments Inc., and the sample is heated up to 200° C. from a room temperature at a programming speed of 30° C./min and cooled. Next, the temperature is measured from 20 to 120° C. at a programming speed of 10° C./min. A shoulder value of the main endothermic peak from 30 to 90° C. in the heating process is determined as a Tg. Alumina is placed in aluminum pan as a reference.

1.0 g of a sample is placed in flow tester CFT-500 from Shimadzu Corp. using a die having a diameter of 0.5 mm and a height of 1.0 mm, and a temperature at a half of the sample flowed at a programming speed of 3.0° C./min, preheating time of 3 min, a load of 30 kgs from 40 to 140° C. is determined as a Tm.

TABLE 1-1

| Resin | BPA-EO (mol) | BPA-PO (mol) | AA (mol) | DSA (mol) | FA (mol) | TMA (mol) | HMDA (mol) |
|---|---|---|---|---|---|---|---|
| I-1 | 1.9 | 0.1 | 0.1 | 0.3 | — | 0.6 | — |
| I-2 | 1.9 | — | 0.1 | 0.2 | — | 0.8 | — |
| I-3 | 1.9 | 0.1 | 0.1 | 0.3 | — | 0.7 | — |
| I-4 | 1.9 | 0.1 | 0.1 | 0.4 | — | 0.5 | — |
| I-5 | 0.1 | 1.9 | — | — | 0.3 | 0.3 | — |
| I-6 | 0.1 | 1.9 | — | — | 0.2 | 0.3 | — |
| I-7 | 1.9 | 0.1 | 0.1 | 0.5 | — | 0.5 | — |
| I-8 | 1.9 | 0.1 | — | — | 1.1 | 0.2 | — |
| II-1 | 2.3 | 2.4 | — | 0.7 | 1.5 | 1.3 | — |
| II-2 | 2.4 | 2.3 | 0.1 | 0.6 | 1.3 | 1.4 | — |
| II-3 | 2.3 | 2.4 | — | 0.8 | 1.4 | 1.2 | — |
| II-4 | 2.6 | 2.1 | — | 0.6 | 1.4 | 1.3 | — |
| II-5 | 2.4 | 2.3 | — | 0.5 | 1.3 | 1.0 | — |
| II-6 | 2.4 | 2.3 | 0.2 | 0.5 | 1.3 | 0.8 | — |
| II-7 | 2.6 | 2.1 | 0.5 | 0.4 | 0.8 | 1.4 | — |
| III-1 | 1.0 | 1.0 | — | 0.2 | 0.6 | 1.4 | — |
| III-2 | 1.0 | 1.0 | — | 0.1 | 0.5 | 1.3 | — |
| III-3 | 1.0 | 1.0 | — | 0.2 | 0.6 | 1.5 | — |
| III-4 | 1.0 | 1.0 | — | 0.1 | 0.1 | 1.4 | — |
| III-5 | 0.6 | 1.4 | — | 0.4 | — | 1.0 | 0.2 |
| III-6 | 0.9 | 1.1 | — | 0.2 | 1.8 | 0.3 | — |

*HMDA: hexamethylenediamine

TABLE 1-2

| Resin | DBO (mmol) | TPA (mol) | St (mol) | EHA (mol) | BA (mol) | DCP (mol) | Tm ° C. | Tg ° C. |
|---|---|---|---|---|---|---|---|---|
| I-1 | 12 | 1.0 | 2.0 | 0.3 | 0.2 | 0.08 | 145 | 60 |
| I-2 | 12 | 1.0 | 2.0 | 0.4 | 0.2 | 0.06 | 142 | 63 |
| I-3 | 12 | 1.0 | 2.0 | 0.2 | 0.2 | 0.10 | 148 | 57 |
| I-4 | 12 | 1.0 | 2.0 | 0.3 | 0.2 | 0.16 | 150 | 53 |
| I-5 | 12 | 1.5 | 2.0 | — | 0.4 | 0.06 | 140 | 62 |
| I-6 | 12 | 1.5 | 2.0 | 0.1 | 0.4 | 0.06 | 138 | 63 |
| I-7 | 12 | 1.0 | 2.0 | 0.2 | 0.2 | 0.12 | 152 | 56 |
| I-8 | 12 | 1.5 | 3.2 | 0.5 | 0.5 | 0.08 | 142 | 73 |
| II-1 | 20 | 1.4 | — | — | — | — | 110 | 65 |
| II-2 | 20 | 1.5 | — | — | — | — | 113 | 68 |
| II-3 | 20 | 1.5 | — | — | — | — | 107 | 62 |
| II-4 | 24 | 1.8 | — | — | — | — | 115 | 58 |
| II-5 | 24 | 1.9 | — | — | — | — | 105 | 72 |
| II-6 | 24 | 1.9 | — | — | — | — | 103 | 70 |
| II-7 | 24 | 1.6 | — | — | — | — | 117 | 60 |
| III-1 | 12 | 0.1 | — | — | — | — | 140 | 75 |
| III-2 | 12 | 0.4 | — | — | — | — | 137 | 72 |
| III-3 | 12 | — | — | — | — | — | 143 | 78 |
| III-4 | 12 | 0.7 | — | — | — | — | 133 | 73 |
| III-5 | 12 | 0.4 | — | — | — | — | 147 | 71 |
| III-6 | 12 | — | — | — | — | — | 143 | 60 |

In the following Examples and Comparative Examples, each of the complex polyester resins I-1 to I-8 and polyester resins II-1 to II-7 and III-1 to III-6 was crushed to have a size of 2 mm or less to prepare a toner.

In addition, the following materials were mixed by Henschel Mixer to prepare a mixture.

| | |
|---|---|
| C.I. Pigment Red 57-1 from Fuji Pigment Co., Ltd. | 50 |
| Each binder resin used in Examples and Comparative Examples | 50 |
| Water | 30 |

The mixture was kneaded by a two-roll kneader having a roll surface temperature of 130° C., cooled and pulverized to prepare particles having a diameter of 1 mm, which were used as a masterbatch.

Example 1

The resins i1, II-1 and III-1 were mixed at a ratio shown in Table 2-1 to prepare a binder resin. After 100 parts of the binder resin (including a wax as shown in Table 3-2) and 5.0 parts of C.I. Pigment Red 57-1 were mixed by Henschel Mixer to prepare a mixture, the mixture was kneaded by a grind kneader as shown in FIG. 1 under the conditions shown in Table 3-1 to prepare a kneaded mixture. The kneaded mixture was extended upon application of pressure by a cooling press roller to have a thickness shown in Table 3-1, conveyed by a belt and crushed by a feather mill. Then, the crushed mixture was further crushed by a mechanical crusher 100AFG from Hosokawa Micron Corp. while classified, and pulverized by a rotor classifier 50ATP from Hosokawa Micron Corp. to prepare toner particles 1 having a diameter of 7 μm.

100 parts of the toner particles, 1.0 part of a hydrophobic silica R974 from Nippon Aerosil Co., Ltd., 1.0 part of a hydrophobic silica AEROSIL 90G from Nippon Aerosil Co., Ltd., treated with hexamethylenedisilazane, having a BET specific surface area of 65 $m^2/g$, pH of 6.0 and a hydrophobicity not less than 65% were mixed with a HENSCHEL MIXER at a peripheral speed of 40 m/sec for 90 sec, and sieved with a sieve having an opening of 75 μm to prepare a toner.

In Table 2-1, H (of H/L) is a total ratio of the resins I and III and L (of H/L) is a ratio of the resin II.

Examples 2 to 24 and Comparative Examples 1 to 6

The procedure for preparation of the toner in Example 1 was repeated except for changing the binder resins, the mixing (weight) ratio thereof, wax, the content thereof and kneading conditions as shown in Tables 3-1 and 3-2.

The wax quantity shown in Table 3-2 is a weight ratio of the wax based on total weight thereof and the binder resin.

In Comparative Example 5, the resin I (hybrid resin) was replaced with the non-hybrid resin not having a unit obtained from radical polymerization in its molecular.

In Comparative Example 6, the resin III (non-hybrid resin) was replaced with the hybrid resin having an amorphous unit obtained from condensation polymerization and a unit obtained from radical polymerization in its molecular frame.

TABLE 2-1

| | Resin I | Resin III | Resins | H/L |
|---|---|---|---|---|
| Example 1 | 15 | 35 | I-1, II-1, III-1 | 50/50 |
| Example 2 | 11 | 39 | I-1, II-1, III-1 | 50/50 |
| Example 3 | 19 | 31 | I-1, II-1, III-1 | 50/50 |
| Example 4 | 15 | 30 | I-2, II-2, III-2 | 45/55 |
| Example 5 | 11 | 34 | I-2, II-2, III-2 | 45/55 |
| Example 6 | 18 | 27 | I-2, II-2, III-2 | 45/55 |
| Example 7 | 15 | 40 | I-3, II-3, III-3 | 55/45 |
| Example 8 | 11 | 44 | I-3, II-3, III-3 | 55/45 |
| Example 9 | 19 | 36 | I-3, II-3, III-3 | 55/45 |
| Example 10 | 15 | 45 | I-1, II-1, III-1 | 60/40 |
| Example 11 | 15 | 25 | I-1, II-1, III-1 | 40/60 |
| Example 12 | 15 | 35 | I-4, II-4, III-1 | 50/50 |
| Example 13 | 15 | 35 | I-5, II-5, III-2 | 50/50 |
| Example 14 | 15 | 40 | I-6, II-6, III-4 | 55/45 |
| Example 15 | 15 | 30 | I-7, II-7, III-5 | 45/55 |
| Example 16 | 15 | 35 | I-1, II-1, III-1 | 50/50 |

TABLE 2-1-continued

| | Resin I | Resin III | Resins | H/L |
|---|---|---|---|---|
| Example 17 | 15 | 35 | I-1, II-1, III-1 | 50/50 |
| Example 18 | 15 | 35 | I-1, II-1, III-1 | 50/50 |
| Example 19 | 15 | 35 | I-1, II-1, III-1 | 50/50 |
| Example 20 | 15 | 35 | I-1, II-1, III-1 | 50/50 |
| Example 21 | 15 | 35 | I-1, II-1, III-1 | 50/50 |
| Example 22 | 15 | 35 | I-1, II-1, III-1 | 50/50 |
| Example 23 | 15 | 35 | I-1, II-1, III-1 | 50/50 |
| Example 24 | 15 | 35 | I-1, II-1, III-1 | 50/50 |
| Comparative Example 1 | 25 | 25 | I-1, II-1, III-1 | 50/50 |
| Comparative Example 2 | 5 | 45 | I-1, II-1, III-1 | 50/50 |
| Comparative Example 3 | 15 | 55 | I-1, II-1, III-1 | 70/30 |
| Comparative Example 4 | 15 | 15 | I-1, II-1, III-1 | 30/70 |
| Comparative Example 5 | 15 | 35 | III-6, II-1, III-1 | 50/50 |
| Comparative Example 6 | 15 | 35 | I-1, II-1, I-8 | 50/50 |

TABLE 2-1

| | Tg | | | Tm | | |
|---|---|---|---|---|---|---|
| | Resin III | Resin II | Resin I | Resin II | Resin III | Resin I |
| Example 1 | 75 | 65 | 60 | 110 | 140 | 145 |
| Example 2 | 75 | 65 | 60 | 110 | 140 | 145 |
| Example 3 | 75 | 65 | 60 | 110 | 140 | 145 |
| Example 4 | 72 | 68 | 63 | 113 | 137 | 142 |
| Example 5 | 72 | 68 | 63 | 113 | 137 | 142 |
| Example 6 | 72 | 68 | 63 | 113 | 137 | 142 |
| Example 7 | 78 | 62 | 57 | 107 | 143 | 148 |
| Example 8 | 78 | 62 | 57 | 107 | 143 | 148 |
| Example 9 | 78 | 62 | 57 | 107 | 143 | 148 |
| Example 10 | 75 | 65 | 60 | 110 | 140 | 145 |
| Example 11 | 75 | 65 | 60 | 110 | 140 | 145 |
| Example 12 | 75 | 58 | 53 | 115 | 140 | 150 |
| Example 13 | 72 | 72 | 62 | 103 | 137 | 140 |
| Example 14 | 73 | 70 | 63 | 117 | 133 | 138 |
| Example 15 | 71 | 60 | 56 | 110 | 147 | 152 |
| Example 16 | 75 | 65 | 60 | 110 | 140 | 145 |
| Example 17 | 75 | 65 | 60 | 110 | 140 | 145 |
| Example 18 | 75 | 65 | 60 | 110 | 140 | 145 |
| Example 19 | 75 | 65 | 60 | 110 | 140 | 145 |
| Example 20 | 75 | 65 | 60 | 110 | 140 | 145 |
| Example 21 | 75 | 65 | 60 | 110 | 140 | 145 |
| Example 22 | 75 | 65 | 60 | 110 | 140 | 145 |
| Example 23 | 75 | 65 | 60 | 110 | 140 | 145 |
| Example 24 | 75 | 65 | 60 | 110 | 140 | 145 |
| Comparative Example 1 | 75 | 65 | 60 | 110 | 140 | 145 |
| Comparative Example 2 | 75 | 65 | 60 | 110 | 140 | 145 |
| Comparative Example 3 | 75 | 65 | 60 | 110 | 140 | 145 |
| Comparative Example 4 | 75 | 65 | 60 | 110 | 140 | 143 |
| Comparative Example 5 | 73 | 65 | 60 | 110 | 142 | 145 |
| Comparative Example 6 | | | | | | |

The glossiness, separativeness, adherence to the regulation blade and filming of the toners prepared in Examples 1 to 24 and Comparative Examples 1 to 6 were evaluated. The results are shown in Table 3-2.

TABLE 3-1

| | Kneading Conditions | | | | |
|---|---|---|---|---|---|
| | C (° C.) | D (° C.) | E (° C.) | Z (mm) | Kneader |
| Example 1 | 20 | 35 | 75 | 2.85 | Grind |
| Example 2 | 20 | 35 | 75 | 2.85 | Grind |
| Example 3 | 20 | 35 | 75 | 2.85 | Grind |
| Example 4 | 20 | 35 | 75 | 2.85 | Grind |
| Example 5 | 20 | 35 | 75 | 2.85 | Grind |
| Example 6 | 20 | 35 | 75 | 2.85 | Grind |
| Example 7 | 20 | 35 | 75 | 2.85 | Grind |
| Example 8 | 20 | 35 | 75 | 2.85 | Grind |
| Example 9 | 20 | 35 | 75 | 2.85 | Grind |
| Example 10 | 20 | 35 | 75 | 2.85 | Grind |
| Example 11 | 20 | 35 | 75 | 2.85 | Grind |
| Example 12 | 20 | 35 | 75 | 2.85 | Grind |
| Example 13 | 20 | 35 | 75 | 2.85 | Grind |
| Example 14 | 20 | 35 | 75 | 2.85 | Grind |
| Example 15 | 20 | 35 | 75 | 2.85 | Grind |
| Example 16 | 20 | 35 | 75 | 2.85 | Grind |
| Example 17 | 20 | 35 | 75 | 2.85 | Grind |
| Example 18 | 20 | 35 | 75 | 2.85 | Grind |
| Example 19 | 20 | 35 | 75 | 2.85 | Grind |
| Example 20 | 20 | 35 | 75 | 2.85 | Grind |
| Example 21 | 13 | 25 | 90 | 3.2 | Grind |
| Example 22 | 27 | 45 | 60 | 2.3 | Grind |
| Example 23 | 20 | 35 | 75 | 2.85 | Biaxial |
| Example 24 | 20 | 35 | 75 | 2.85 | Monoaxial |
| Comparative Example 1 | 20 | 35 | 75 | 2.85 | Grind |
| Comparative Example 2 | 20 | 35 | 75 | 2.85 | Grind |
| Comparative Example 3 | 20 | 35 | 75 | 2.85 | Grind |
| Comparative Example 4 | 20 | 35 | 75 | 2.85 | Grind |
| Comparative Example 5 | 20 | 35 | 75 | 2.85 | Grind |
| Comparative Example 6 | 20 | 35 | 75 | 2.85 | Grind |

*C: a heater average temperature of B1 in FIG. 1,
D: a heater average temperature of A in FIG. 1
E: a difference of heater average temperatures between A and B2 in FIG. 1.
Z: extended thickness

TABLE 3-2

| | Wax | | Evaluation | | | |
|---|---|---|---|---|---|---|
| | Name | Qty. | Glossiness | Separativeness | Adherence | Filming |
| Example 1 | 73 | 3 | 10 | ○ | ○ | ○ |
| Example 2 | 73 | 3 | 11 | ○ | ○ | Δ |
| Example 3 | 73 | 3 | 9 | ○ | Δ | ○ |
| Example 4 | 73 | 3 | 12 | Δ | ○ | ○ |
| Example 5 | 73 | 3 | 13 | ○ | ○ | Δ |
| Example 6 | 73 | 3 | 11 | ○ | Δ | ○ |
| Example 7 | 73 | 3 | 8 | ○ | ○ | ○ |
| Example 8 | 73 | 3 | 9 | ○ | ○ | Δ |
| Example 9 | 73 | 3 | 7 | ○ | Δ | ○ |
| Example 10 | 73 | 3 | 6 | Δ | ○ | ○ |
| Example 11 | 73 | 3 | 14 | ○ | ○ | ○ |
| Example 12 | 73 | 3 | 6 | Δ | ○ | ○ |
| Example 13 | 73 | 3 | 14 | Δ | Δ | ○ |
| Example 14 | 78 | 3 | 15 | Δ | Δ | ○ |
| Example 15 | 82 | 3 | 5 | ○ | ○ | ○ |
| Example 16 | 67 | 3 | 10 | ○ | ○ | ○ |
| Example 17 | 73 | 3.4 | 10 | ○ | ○ | Δ |
| Example 18 | 73 | 2.6 | 10 | ○ | Δ | ○ |
| Example 19 | 73 | 3 | 10 | ○ | Δ | Δ |
| Example 20 | 73 | 3 | 10 | Δ | ○ | ○ |
| Example 21 | 73 | 3 | 9 | Δ | ○ | ○ |
| Example 22 | 73 | 3 | 11 | ○ | Δ | Δ |
| Example 23 | 73 | 3 | 10 | Δ | ○ | ○ |

TABLE 3-2-continued

| | Wax | | Evaluation | | | |
|---|---|---|---|---|---|---|
| | Name | Qty. | Glossiness | Separa-tiveness | Adherence | Filming |
| Example 24 | 73 | 3 | 10 | Δ | ○ | ○ |
| Comparative Example 1 | 73 | 3 | 10 | ○ | X | ○ |
| Comparative Example 2 | 73 | 3 | 11 | ○ | ○ | X |
| Comparative Example 3 | 73 | 3 | 3.5 | ○ | ○ | ○ |
| Comparative Example 4 | 73 | 3 | 17 | X | Δ | ○ |
| Comparative Example 5 | 73 | 3 | 10 | ○ | X | X |
| Comparative Example 6 | 73 | 3 | 10 | ○ | X | ○ |

The names of waxes are shown in Table 4.

TABLE 4

| Name | Melting point (° C.) | Sort of Wax |
|---|---|---|
| 73 | 73 | Paraffin |
| 82 | 82 | Fischer Tropsch |
| 67 | 67 | Paraffin |
| 78 | 78 | Carnauba |

<Glossiness>

The linear speed and temperature of the fixer of IPSiO CX2500 from Ricoh Company, Ltd. were modified to have 125 mm/sec and 165° C., respectively. A solid image developed with the toner of 1.1±0.1 mg/cm$^2$ having a 3 mm wide blank at the tip was fixed on a transfer paper TYPE 6200 Y from Ricoh Company, Ltd. The image glossiness was measured with a gloss meter from Nippon Denshoku Industries Co., Ltd. at an incident angle of 60°.

<Separativeness>

A two-component developer including 5 parts of the toner and 95 parts of silicone-resin coated carrier was set in the modified ipsio CX7500 from Ricoh Company, Ltd., from which the fixer was taken out, and 6 unfixed solid images having a 3-mm wide blank at the end, on which the toner was developed at 1.1±0.1 mg/cm$^2$, were produced thereby on transfer papers Ricoh 6200 Y.

Only the fixer was taken out from ipsio CX2500 from Ricoh Company, Ltd., and the linear speed and temperature of the fixing belt were modified to have 125 mm/sec and from 140 to 190° C. (by 10° C.), respectively. The unfixed toner images were fixed from the blanks.

○: 5 or more sheets were normally fixed without winding of the transfer papers around the fixing belt or blocking thereof at the exit of the fixer like accordions (good)

Δ: 3 to 4 sheets were normally fixed (usable)

x: 2 or less sheets were normally fixed (unusable)

<Adherence>

After 3,000 predetermined print pattern images having a printed ratio of 6% were continuously produced by IPSiO CX3000 from Ricoh Company, Ltd. at 23° C. and 45% RH, the developing roller and images were visually observed.

○: Neither toner stripe nor stagnation was observed on the sleeve

Δ: Toner stripe or stagnation was slightly observed on the sleeve, but not on the images and practically usable x: Toner stripe or stagnation was widely observed on the sleeve, and practically unusable due to additional problems such as an abnormal noise.

<Filming>

After 3,000 predetermined print pattern images having a printed ratio of 6% were continuously produced by IPSiO CX3000 from Ricoh Company, Ltd. at 23° C. and 45% RH, the photoreceptor and intermediate transfer belt were visually observed.

○: Neither filming nor black spot was observed

Δ: Filming or black spot was observed on the photoreceptor or intermediate transfer belt, but not on the images and practically usable x: Filming or black spot was observed on the photoreceptor or intermediate transfer belt, and on the images and practically unusable Table 3-2 shows that the non-magnetic toner for one-component development of the present invention can be used without problems of glossiness, separativeness, adherence and filming. On the other hand, each of the toners prepared in Comparative Examples has at least a problem of glossiness, separativeness, adherence or filming.

This application claims priority and contains subject matter related to Japanese Patent Application No. 2008-010430 filed on Jan. 21, 2008, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A non-magnetic toner for one-component development, comprising:

a binder resin, comprising:

a first resin, a second resin, a third resin;

a colorant; and a wax, wherein the first resin is a hybrid resin comprising an amorphous unit obtained from condensation polymerization and a unit obtained from radical polymerization in its molecular frame, and the second and third resins are non-hybrid resins comprising units obtained from condensation polymerization, respectively, wherein each of the first, second and third resins has a glass transition temperature (Tg) and a softening point (Tm) satisfying the following relationships:

Tg of the first resin<Tg of the second resin<Tg of the third resin, which is from 70 to 80° C., and Tm of the second resin<Tm of the third resin<Tm of the first resin, and wherein the binder resin comprises the first resin in an amount of from 10 to 20% by weight and the third resin of from 25 to 45% by weight.

2. The non-magnetic toner for one-component development of claim 1, wherein the first resin has a glass transition temperature (Tg) of from 50 to 65° C. and a softening point (Tm) of from 135 to 155° C., and the third resin has a softening point (Tm) of from 130 to 150° C.

3. The non-magnetic toner for one-component development of claim 1, wherein the first resin is a hybrid resin comprising a polyester frame unit and a vinyl copolymer frame, and the second and third resins are non-hybrid resins comprising polyester frame units, respectively.

4. The non-magnetic toner for one-component development of claim 1, wherein the second resin has a glass transition temperature (Tg) of from 60 to 75° C. and a softening point (Tm) of from 100 to 120° C., and the binder resin comprises the second resin in an amount of from 40 to 60% by weight.

5. The non-magnetic toner for one-component development of claim 1, wherein the wax has a melting point of from 70 to 80° C. and a weight ratio of from 2.75 to 3.25% based on total weight of the binder resin and the wax.

6. A method of preparing a non-magnetic toner for one-component development, comprising:

melting and kneading toner constituents, comprising a binder resin comprising a first resin, a second resin, and a third resin; a colorant; and a wax with a kneader to prepare a kneaded mixture, extending upon application of pressure and cooling the kneaded mixture to prepare an extended and cooled mixture, and pulverizing and classifying the extended and cooled mixture, wherein the first resin is a hybrid resin comprising an amorphous unit obtained from condensation polymerization and a unit obtained from radical polymerization in its molecular frame, and the second and third resins are non-hybrid resins comprising units obtained from condensation polymerization, respectively, wherein each of the first, second and third resins has a glass transition temperature (Tg) and a softening point (Tm) satisfying the following relationships:

Tg of the first resin<Tg of the second resin<Tg of the third resin, which is from 70 to 80° C., and Tm of the second resin<Tm of the third resin<Tm of the first resin, and wherein the binder resin comprises the first resin in an amount of from 10 to 20% by weight and the third resin of from 25 to 45% by weight.

7. The method of claim 6, wherein the first resin is a hybrid resin comprising a polyester frame unit and a vinyl copolymer frame, and the second and third resins are non-hybrid resins comprising polyester frame units, respectively, wherein the first resin has a glass transition temperature (Tg) of from 50 to 65° C. and a softening point (Tm) of from 135 to 155° C., wherein the binder resin comprises the first resin in an amount of from 10 to 20% by weight, and wherein the third resin has a glass transition temperature (Tg) of from 70 to 80° C. and a softening point (Tm) of from 130 to 150° C., and wherein the binder resin comprises the third resin in an amount of from 25 to 45% by weight.

8. The method of claim 6, wherein the kneader comprises:

an independent toner material disperser having a heater (A); and a first feeder (B1) including an independent toner material feeder having a heater, and a second feeder (B2) including an independent kneaded mixture outlet having a heater, sandwiching the disperser (A), wherein B1 has a heater average temperature (C) of from 15 to 25° C., A has a heater average temperature (D) of from 30 to 40° C., and A and B2 have heater average temperatures having a difference (E) of from 65 to 85° C. therebetween, and wherein the extended and cooled mixture has a thickness of from 2.5 to 3.0 mm.

9. The method of claim 8, wherein the disperser (A) comprises outer grind heads and inner grind heads have a gap therebetween.

10. The method of claim 6, wherein the toner constituents are dry blend materials comprising a hybrid resin synthesized under the presence of a wax, a non-hybrid resin and a colorant.

11. An image developer, comprising:

a developer bearer configured to face a photoreceptor and bear a toner to develop a latent image formed on the photoreceptor;

a feeder configured to face the developer bearer and feed the toner thereto while contacting thereto; and a layer thickness regulator configured to form a thin layer of the toner fed from the feeder on the developer bearer and face the developer bearer between opposed positions to the feeder and the photoreceptor in the traveling direction of the developer bearer, wherein the toner is the non-magnetic toner for one-component development according to claim 1.

12. The image developer of claim 11, wherein the image developer has an upright structure having a toner feeder on the top, and the layer thickness regulator and the developer bearer contact each other with their bodies.

13. An image forming apparatus, comprising:

a photoreceptor configured to bear an image;

a charger configured to charge the photoreceptor;

an irradiator configured to irradiate the photoreceptor to form an electrostatic latent image thereon;

an image developer configured to develop the electrostatic latent image to form a toner image;

a transferer configured to transfer the toner image onto a receiving material; and a fixer configured to fix the toner image on the receiving material, wherein the image developer is the image developer according to claim 11.

14. The image forming apparatus of claim 13, wherein the fixer is a two-roll fixer comprising a heat roller, a pressure roller and a fixing member without the application of oil.

15. A process cartridge detachable from an image forming apparatus, comprising a photoreceptor and the image developer according to claim 11.

16. An image forming method, comprising:

charging a photoreceptor;

irradiating the photoreceptor to form an electrostatic latent image thereon;

developing the electrostatic latent image with the non-magnetic toner for one-component development according to claim 1 to form a toner image;

transferring the toner image onto a receiving material; and fixing the toner image on the receiving material.

17. The image forming method of claim 16, wherein the toner image has a glossiness of from 5 to 15.

* * * * *